US006932154B2

(12) United States Patent
Zillinger

(10) Patent No.: US 6,932,154 B2
(45) Date of Patent: Aug. 23, 2005

(54) PRESSURE SENSOR INSERT FOR A DOWNHOLE TOOL

(75) Inventor: Fred Zillinger, Sylvan Lake (CA)

(73) Assignee: Canada Tech Corporation (CA)

( * ) Notice: Subject to any disclaimer, the term of this patent is extended or adjusted under 35 U.S.C. 154(b) by 0 days.

(21) Appl. No.: 10/663,289

(22) Filed: Sep. 16, 2003

(65) Prior Publication Data

US 2005/0056415 A1 Mar. 17, 2005

(51) Int. Cl.[7] ..... E21B 47/01
(52) U.S. Cl. ..... 166/66; 166/250.11
(58) Field of Search ..... 166/66, 65.1, 250.01, 166/250.07, 250.11; 175/40, 50

(56) References Cited

U.S. PATENT DOCUMENTS

| | | | | |
|---|---|---|---|---|
| 3,939,705 A | | 2/1976 | Glotin et al. | |
| 4,105,279 A | * | 8/1978 | Glotin et al. | 439/201 |
| 4,506,731 A | | 3/1985 | Skinner | |
| 4,582,136 A | | 4/1986 | Skinner | |
| 4,593,771 A | | 6/1986 | Comeau | |
| 4,967,853 A | | 11/1990 | Landry | |
| 5,047,635 A | | 9/1991 | Leaney et al. | |
| 5,327,971 A | | 7/1994 | Garbutt et al. | |
| 5,419,405 A | * | 5/1995 | Patton | 175/27 |
| 6,367,545 B1 | * | 4/2002 | Van Buskirk et al. | 166/53 |
| 6,523,609 B1 | * | 2/2003 | Miszewski | 166/66 |
| 6,705,406 B2 | * | 3/2004 | Das et al. | 166/381 |

FOREIGN PATENT DOCUMENTS

| | | |
|---|---|---|
| EP | 0 699 821 A1 | 3/1996 |
| GB | 2354022 A | 3/2001 |
| GB | 2366308 A | 3/2002 |

OTHER PUBLICATIONS

"iGauge—Pressure and Temperature electronic Memory Insert Gauge," 4 pages, downloaded from Metrolog website www.metrolog.com.

"iQuartz—Pressure and Temperature Electronic Memory Insert Gauge with Quartz Crystal Sensor," 1 page, downloaded from Metrolog website www.metrolog.com.

* cited by examiner

*Primary Examiner*—David Bagnell
*Assistant Examiner*—K. Thompson
(74) *Attorney, Agent, or Firm*—Terrence N. Kuharchuk; Rodman & Rodman

(57) ABSTRACT

A replaceable pressure sensor insert adapted for removable connection with an insert carrier. The pressure sensor insert is comprised of a housing defining an exterior and an interior of the housing, a pressure sensor connected with the housing such that the pressure sensor is capable of sensing an ambient pressure at the exterior of the housing and an electronics assembly contained within the interior of the housing and electrically connected with the pressure sensor. In addition, the insert is comprised of a first insert mounting component adapted to be removably connectable with a second insert mounting component associated with the insert carrier in order to facilitate connection and replacement of the insert. Finally, a housing sealing mechanism is provided for sealing the insert relative to the insert carrier and a sensor sealing mechanism is provided for sealing the pressure sensor relative to the housing.

26 Claims, 4 Drawing Sheets

PRESSURE SENSOR INSERT FOR A DOWNHOLE TOOL

FIELD OF INVENTION

The present invention relates to a pressure sensor insert which is for use in a downhole tool or apparatus. More particularly, the invention relates to a replaceable pressure sensor insert which is adapted for removable connection with an insert carrier, which is preferably a downhole production or drilling tool or apparatus.

BACKGROUND OF INVENTION

Conventionally, pressure sensors or transducers are mounted within a desired downhole tool or apparatus which is custom built or designed to receive the pressure sensor. These pressure sensors are fixedly or non-removably mounted within the tool at the manufacturing facility or machine shop and shipped to the customer for use in the field. Accordingly, the pressure sensors are required to be calibrated in the shop prior to mounting within the tool.

During use of the tool in the field, the pressure sensor may be exposed to conditions which either damage the pressure sensor or adversely affect the calibration of the pressure sensor. As a result, repair or re-calibration of the pressure sensor may be required. Further, depending upon the conditions encountered downhole, it may be desirable to use a variety of pressure sensors with varying pressure ratings throughout the production or drilling operation. As a result, replacement of the pressure sensor with an alternate pressure sensor may be desirable throughout the production or drilling operation.

In each of these cases, the pressure sensor is not capable of being replaced, repaired or re-calibrated in the field. Rather, the entire tool must be returned to the shop for removal of the pressure sensor from the tool such that the pressure sensor may be repaired, replaced or further calibrated. During this period, the tool is unavailable for use which results in undesirable downtime for the tool and increased costs for the production or drilling operation.

Further, as indicated, the tool is custom designed or built to accept a particular desired pressure sensor for mounting therein. Specifically, the manufacturing facility or machine shop is required to custom build each tool to accept a particular pressure sensor with a desired pressure rating to meet the requirements of each particular customer. As a result, the shop is typically required to keep a relatively large inventory of tools available in order to be in a position to meet the needs of the customer in a timely manner. Further, the shop must be capable of calibrating all of the different types and sizes of tools in which the pressure sensors are mounted.

As a result, removable pressure sensors have been developed. However, none of these removable pressure sensors have been found to be fully satisfactory. Examples of removable pressure sensors include: United Kingdom Patent Application No. GB 2,366,308 A published Mar. 6, 2002 by Ryan Energy Technologies Inc.; U.S. Pat. No. 3,939,705 issued Feb. 24, 1976 to Glotin et. al.; U.S. Pat. No. 4,105,279 issued Aug. 8, 1978 to Glotin et. al.; U.S. Pat. No. 4,506,731 issued Mar. 26, 1985 to Skinner; U.S. Pat. No. 4,582,136 issued Apr. 15, 1986 to Skinner; and U.S. Pat. No. 4,967,853 issued Nov. 6, 1990 to Landry.

In addition, many pressure sensors used downhole have not been found to be fully satisfactory due to a proneness towards de-calibration and failure for several reasons. First, repeated removal and replacement of the pressure sensor tends to stress a metal housing typically surrounding or enclosing at least a part of the pressure sensor which disturbs the calibration of the pressure sensor therein. In addition, the handling of the pressure sensor during its removal and replacement may also adversely affect the calibration of the sensor.

Second, in use, the interior of the metal housing for the pressure sensor is typically exposed to high ambient pressure downhole. Exposure of the pressure sensor to multiple pressure cycles tends to cause a stretching of the metal housing over time which also adversely affects the calibration of the pressure sensor.

Finally, conventional pressure sensors are sealed and held within the metal housing by the use of one or more O-rings so that the pressure sensor may be easily removed from the housing in the event of the failure of the pressure sensor. However, the O-rings themselves are prone to failure and decrease the reliability of the tool and the pressure sensor in the field. For instance, O-rings tend to corrode resulting in a tendency to fail. As well, O-rings permit certain undesirable gases, such as carbon dioxide, to pass therethrough which may adversely affect the electronic components of the pressure sensor.

As a result, there is a need in the industry for an improved pressure sensor for use in a downhole tool or apparatus. Further, there is a need for a replaceable pressure sensor insert which is adapted for removable connection with an insert carrier such as a downhole production or drilling tool or apparatus. Preferably, the pressure sensor insert and the pressure sensor therein address one or more of the disadvantages or undesirable features associated with conventional or known fixed or replaceable pressure sensors as discussed above.

SUMMARY OF INVENTION

The present invention relates to a pressure sensor for use in a downhole tool or apparatus. Further, the present invention particularly relates to a replaceable pressure sensor insert adapted for removable connection with an insert carrier, wherein the pressure sensor insert is comprised of the pressure sensor. Any type or rating of pressure sensor may be used. Further, the insert carrier may be comprised of any downhole tool, apparatus or sub assembly, including any downhole production or drilling tool, apparatus or sub assembly.

In the preferred embodiment, the replaceable pressure sensor insert is universal or modular such that it is adapted or configured to be removably connected with any compatible insert carrier. The pressure sensor comprising the replaceable pressure sensor insert may be of any desired type or pressure rating. Accordingly, the requirements of a particular customer or a particular downhole operation may be met by selecting a pressure sensor insert including the desired pressure sensor and removably connecting the pressure sensor insert with the compatible insert carrier. Thus, only a single insert carrier needs to be manufactured which is compatible for connecting with the pressure sensor insert. If for any reason the pressure sensor requires replacement, repair or re-calibration, the pressure sensor insert need only be disconnected from the insert carrier and replaced with an alternate pressure sensor insert.

Further, in the preferred embodiment, the pressure sensor insert is configured such that it may be readily connected with and disconnected from the insert carrier. As a result, the pressure sensor insert may be removed and replaced in the field without the need to transport the entire insert carrier to the shop. The pressure sensor insert removed in the field may then be returned to the shop for repair or re-calibration, or simply disposed of. Accordingly, the manufacturing facility or machine shop need only maintain and calibrate an inventory of pressure sensor inserts, rather than the entire insert carrier. Further, the customer may keep one or more spare or replacement pressure sensor inserts on hand to further minimize any down time of the operation in the event of failure of the pressure sensor or the need for use of a different pressure sensor.

In addition, the pressure sensor insert is preferably configured to reduce any stress to the pressure sensor and the likelihood of disturbing the calibration of the pressure sensor as a result of its use or as a result of the connection and disconnection of the pressure sensor insert with the insert carrier.

Specifically, in the preferred embodiment, the pressure sensor insert is configured to minimize or completely avoid any handling of the pressure sensor during the removal and replacement of the pressure sensor insert. Further, in the preferred embodiment, the pressure sensor is balanced such that the pressure sensor is exposed both internally and externally to the ambient pressure in order to reduce any potential for stretching or deformation of the pressure sensor as a result of its repeated use which will adversely affect the calibration of the pressure sensor.

Finally, in the preferred embodiment, the pressure sensor insert is configured such that any sealing of the pressure sensor within the pressure sensor insert, and preferably any sealing of the pressure sensor insert within the insert carrier, is achieved without the use of O-rings as the primary sealing mechanism. Minimizing the use of O-rings as the primary sealing mechanism may improve the reliability of the pressure sensor by reducing the potential for failure of the pressure sensor as a result of deterioration of the O-rings or the passage of undesirable gases therethrough. More particularly, in the preferred embodiment, a metal to metal seal is provided as the primary sealing mechanism between the pressure sensor and the pressure sensor insert and between the pressure sensor insert and the insert carrier.

In a first aspect of the invention, the invention is comprised of a replaceable pressure sensor insert adapted for removable connection with an insert carrier comprising:

(a) a housing, wherein the housing defines an exterior of the housing and wherein the housing defines an interior of the housing;

(b) a pressure sensor connected with the housing such that the pressure sensor is capable of sensing an ambient pressure at the exterior of the housing;

(c) an electronics assembly contained within the interior of the housing and electrically connected with the pressure sensor;

(d) a first insert mounting component adapted to be removably connectable with a second insert mounting component associated with the insert carrier in order to facilitate connection and replacement of the insert;

(e) a housing sealing mechanism for sealing the insert relative to the insert carrier; and (f) a sensor sealing mechanism for sealing the pressure sensor relative to the housing.

As discussed, the pressure sensor insert is replaceable in that it is adapted to be removably or releasably connected with the insert carrier. Preferably, the pressure sensor insert is readily, or relatively easily, connected with and removed from the insert carrier. Further, as discussed, any type or rating of pressure sensor may be used which is compatible with the intended use of the insert carrier including the anticipated downhole conditions. More particularly, the pressure sensor may be comprised of any conventional or known pressure sensor or transducer.

Finally, as discussed, the insert carrier may be comprised of any downhole tool, apparatus or sub assembly, including any downhole production or drilling tool, apparatus or sub assembly. Alternately, the insert carrier may be comprised of a carrier member or intermediate structure for connection with the pressure sensor, which carrier member is in turn adapted for mounting or connection, either permanently or removably, with any downhole tool, apparatus or sub assembly, including any downhole production or drilling tool, apparatus or sub assembly.

Preferably, the insert is comprised of a first insert end and a second insert end. Further, the pressure sensor is preferably located at, adjacent or in proximity to the first insert end. In addition, the insert is preferably configured so that the insert is connected with the insert carrier by advancing the insert relative to the insert carrier in a direction toward the first insert end and wherein the insert is configured so that the insert is disconnected from the insert carrier by retreating the insert relative to the insert carrier in a direction toward the second insert end.

As a result, the pressure sensor insert may be connected with and removed from the insert carrier without handling the pressure sensor at the first insert end. Rather, the pressure sensor insert is handled manually or through use of a tool or device at or adjacent to the second insert end. Preferably, the pressure sensor insert is further comprised of a tool engagement surface located at, adjacent or in proximity to the second insert end which is adapted to engage a tool for advancing and retreating the insert relative to the insert carrier. The tool engagement surface may have any shape or configuration compatible for use with the tool to be used for advancing and retreating the pressure sensor insert. However, in the preferred embodiment, the tool engagement surface is comprised of a hexagonal surface which is adapted to engage a wrench.

As indicated, in order to facilitate connection and replacement of the pressure sensor insert, the pressure sensor insert is comprised of a first insert mounting component which is adapted to be removably connectable with a second insert mounting component associated with the insert carrier. The first and second insert mounting components may be comprised of any compatible structures, members or mechanisms capable of, and suitable for, removably or releasably connecting the pressure sensor insert with the insert carrier.

Preferably, the first insert mounting component is comprised of an insert threaded section associated with the housing which is adapted for threaded engagement with the second insert mounting component in order to removably connect the insert with the insert carrier. Further, the second insert mounting component is preferably comprised of a carrier threaded section associated with the insert carrier which is adapted for threaded engagement with the first insert mounting component. The insert threaded section and the carrier threaded section may have any compatible structures adapted to threadably engage each other.

In the preferred embodiment, the insert threaded section is comprised of a projecting flange associated with the housing and wherein the insert threaded section is further comprised of a thread formed in the projecting flange. More particularly, the insert threaded section, and specifically the projecting flange, is defined by an exterior surface of the housing of the pressure sensor insert. Further, the carrier threaded section is comprised of a compatible thread formed in or defined by an interior surface or bore of the insert carrier.

Accordingly, in the preferred embodiment, the pressure sensor insert is connected with the insert carrier by rotating the insert relative to the insert carrier in a first direction such that the compatible threads of the insert threaded section and the carrier threaded section are engaged and such that the insert advances relative to the insert carrier in the direction toward the first insert end. Conversely, the pressure sensor insert is disconnected from the insert carrier by rotating the insert relative to the insert carrier in a second direction opposed to the first direction such that the compatible threads of the insert threaded section and the carrier threaded section are disengaged and such that the insert retreats relative to the insert carrier in the direction toward the second insert end.

As indicated, the pressure sensor insert is comprised of a housing, wherein the housing defines an exterior and an interior of the housing, a pressure sensor connected with the housing such that the pressure sensor is capable of sensing an ambient pressure at the exterior of the housing, and an electronics assembly contained within the interior of the housing and electrically connected with the pressure sensor.

The pressure sensor may be connected with the housing in any manner and by any mechanism or structure such that the pressure sensor is capable of sensing an ambient pressure at the exterior of the housing. For instance, the pressure sensor may be removably or releasably connected with the housing. However, given the decreased likelihood of failure of the pressure sensor described herein and given that the pressure sensor insert including the pressure sensor is replaceable, and disposable if desired, the pressure sensor is not required to be removable from the insert. Thus, in the preferred embodiment, the pressure sensor is rigidly or fixedly connected with the housing such that the pressure sensor may not be readily removed therefrom. More particularly, the pressure sensor is preferably connected with the housing by welding the sensor with the housing as discussed further below.

The pressure sensor is preferably comprised of two opposed ends. First, the pressure sensor is comprised of a sensing end for sensing the ambient pressure at the exterior of the housing. Second, the pressure sensor is comprised of a connecting end for electrically connecting the pressure sensor with the electronics assembly, wherein the connecting end of the pressure sensor is in communication with the interior of the housing in order to facilitate the electrical connection of the pressure sensor and the electronics assembly.

Further, the pressure sensor preferably defines an exterior of the pressure sensor and further defines an interior chamber of the pressure sensor, wherein the sensing end of the pressure sensor is comprised of a diaphragm for transmitting the ambient pressure from the exterior of the pressure sensor to the interior chamber of the pressure sensor, and wherein the diaphragm is in communication with the exterior of the housing so that the ambient pressure at the exterior of the housing is transmitted to the interior chamber of the pressure sensor. The sensed pressure is then communicated to the electronics assembly.

Conventionally, in known pressure sensors, the ambient pressure is solely applied to the diaphragm for communication to the interior chamber of the pressure sensor. This occurs as a result of the placement of the pressure sensor within the tool and the sealing of the pressure sensor within the tool at its sensing end such that, with the exception of the diaphragm, the pressure sensor is sealed from exposure to the ambient pressure . Exposure of the internal chamber of the pressure sensor to the relatively high ambient pressure tends to cause the outer metal walls of the pressure sensor and the diaphragm to stretch or deform over time with repeated use of the pressure sensor, which disturbs the calibration of the sensor.

Accordingly, as stated previously, in the preferred embodiment, the pressure sensor is balanced. In the preferred embodiment, the insert has a high pressure side which is exposed to the ambient pressure and a low pressure side which is sealed from the ambient pressure. Further, in the preferred embodiment, at least a portion of the interior chamber of the pressure sensor, and preferably the entire interior chamber, is positioned or located on the high pressure side of the insert such that both the interior chamber and the exterior of the pressure sensor surrounding or adjacent to the interior chamber are exposed to the ambient pressure. Accordingly, the ambient pressure is applied from opposed directions from within the interior chamber and from outside the interior chamber to achieve a pressure balancing effect.

More particularly, the pressure sensor is preferably further comprised of a sidewall surrounding the interior chamber of the pressure sensor, wherein the sidewall is comprised of an exterior surface. Further, the insert is preferably configured so that at least a portion of the ambient pressure is exerted on the exterior surface of the sidewall in order to provide a balancing of pressure between the exterior surface of the sidewall and the interior chamber of the pressure sensor. In the preferred embodiment, as discussed above, the insert is configured so that the ambient pressure is exerted on the entire exterior surface of the sidewall in order to enhance or facilitate the balancing of pressure between the exterior surface of the sidewall and the interior chamber of the pressure sensor. In other words, the entire exterior surface of the sidewall surrounding the interior chamber is positioned or located on the high pressure side of the insert.

The sidewall of the pressure sensor surrounding the interior chamber may be exposed to the ambient pressure in any manner directly, indirectly or both. Further, the pressure sensor may be connected or mounted with the housing in any manner permitting the desired exposure of the sidewall of the interior chamber to the ambient pressure. However, in the preferred embodiment, the housing is comprised of a sensor mount which defines a sensor bore for accepting the pressure sensor. Further, the sensor mount is preferably comprised of a sensor bore wall surrounding the sensor bore, and wherein the pressure sensor is positioned within the sensor bore.

The pressure sensor may be positioned partly or entirely within the sensor bore. For instance, the sensing end of the pressure sensor may extend from the sensor bore wall. More particularly, the sidewall of the interior chamber of the pressure sensor may extend in part or in its entirety from the sensor bore wall such that the exterior surface of the sidewall is exposed to the ambient pressure. In other words, the exterior surface of the sidewall of the interior chamber is directly exposed to the ambient pressure to achieve the desired balancing effect.

However, in the preferred embodiment, the sidewall of the interior chamber of the pressure sensor is substantially contained within the sensor bore. More particularly, the sidewall of the interior chamber of the pressure sensor is substantially contained within the sensor bore wall surrounding the sensor bore. In this instance, as discussed further below in greater detail, the housing sealing mechanism and the sensor sealing mechanism must be positioned with respect to the interior chamber such that the exterior surface of the sidewall is exposed in part, and preferably in its entirety, to the ambient pressure directly, indirectly or both.

Preferably, the insert is comprised of the first insert end and the second insert end, wherein the sensing end of the pressure sensor is located at, adjacent or in proximity to the first insert end. Further, preferably, the interior chamber of the pressure sensor is comprised of a distal chamber end adjacent to the sensing end of the pressure sensor, the interior chamber of the pressure sensor is further comprised of a proximal chamber end, and the proximal chamber end is located between the first insert end and at least one of the housing sealing mechanism and the sensor sealing mechanism.

As stated, preferably, the sidewall of the interior chamber of the pressure sensor is substantially contained within the sensor bore. The sensor sealing mechanism may be positioned at any location along the exterior surface of the pressure sensor between the exterior surface of the pressure sensor and the adjacent sensor bore. The sensor sealing mechanism is provided to seal the pressure sensor relative to the housing and thus facilitate the sealing of the interior of the housing from the exterior environment. As a result, the electronics assembly contained within the interior may be sealed or enclosed within the housing.

More particularly, the sensor sealing mechanism may be located at any position along the exterior surface of the pressure sensor between the sensing end and the connecting end. For example, the sensor sealing mechanism may be located at, adjacent or in proximity to the connecting end of the pressure sensor. In other words, the proximal chamber end is located between the first insert end and the sensor sealing mechanism.

This location of the sensor sealing mechanism is required where direct exposure of the exterior surface of the sidewall of the interior chamber to the ambient pressure is desirable. Direct exposure is possible in this case as any space or gap between the exterior surface of the sidewall and the adjacent sensor bore is unsealed and thus communication of the ambient pressure exterior to the housing to the space or gap is permitted. However, preferably, the exterior surface of the sidewall of the interior chamber is alternately indirectly exposed to the ambient pressure.

More particularly, the exterior surface of the sidewall of the interior chamber of the pressure sensor is preferably indirectly exposed to the ambient pressure by transmission or application of the ambient pressure through the adjacent sensor bore wall. More particularly, the thickness of, and material comprising, the sensor bore wall are selected such that the ambient pressure is applied exteriorly to the sensor bore wall and transmitted through the sensor bore wall to the adjacent exterior surface of the sidewall of the interior chamber to substantially balance the ambient pressure transmitted to the interior chamber through the diaphragm.

In order to facilitate or enhance the indirect exposure to the ambient pressure, any space or gap between the adjacent surfaces of the sidewall of the interior chamber and the sensor bore wall is preferably minimized. In the preferred embodiment, a friction fit is provided therebetween. Thus, the balancing effect of the ambient pressure is achieved primarily or substantially through the indirect exposure, even when the sensor sealing mechanism is located adjacent to the connecting end of the pressure sensor or the proximal chamber end is located between the first insert end and the sensor sealing mechanism.

Preferably, the sensor sealing mechanism is located adjacent to the first insert end. More particularly, in the preferred embodiment, the sensor sealing mechanism is located at, adjacent or in proximity to the sensing end of the pressure sensor. Accordingly, any space or gap between the sensor bore of the housing and the adjacent exterior surface of the pressure sensor is sealed from the ambient pressure. However, as indicated, in the preferred embodiment, any such space or gap is preferably minimized in order to facilitate the indirect transmission of the ambient pressure or indirect exposure of the sidewall of the interior chamber to the ambient pressure through the sensor bore wall.

Thus, the proximal chamber end is located between the sensor sealing mechanism and the second insert end. As a result, in order to permit the indirect transmission of the ambient pressure, the housing sealing mechanism is positioned along the exterior surface of the housing such that the proximal chamber end is located between the first insert end and the housing sealing mechanism. Thus, the exterior surface of the sensor bore wall is exposed to the ambient pressure. Further, the housing sealing mechanism provides a seal between the housing of the insert and the insert carrier. In the preferred embodiment, the housing sealing mechanism defines the high and low pressure sides of the insert. The high pressure side which is exposed to the ambient pressure is defined as the portion of the insert between the first insert end and the housing sealing mechanism. The low pressure side of the insert which is sealed from the ambient pressure is defined as the portion of the insert between the second insert end and the housing sealing mechanism. Thus, as discussed previously, in the preferred embodiment, the interior chamber is entirely located within the high pressure side of the insert exposed to the ambient pressure.

In order to further enhance or facilitate this indirect transmission of the ambient pressure, the sensor bore wall is comprised of a relatively thin, compressible or deformable material. Thus, in the preferred embodiment, the sensor bore wall is comprised of a deformable sensor bore wall. As defined herein, the sensor bore wall is considered to be "deformable" where, upon exposure of an exterior surface of the sensor bore wall to the ambient pressure, the sensor bore wall is capable of transmitting at least a portion of the ambient pressure to, or exerting at least a portion of the ambient pressure on, the exterior surface of the sidewall of the interior chamber such that at least a partial balancing effect of the pressure may be achieved between the exterior surface of the sidewall and the interior chamber of the pressure sensor. in the preferred embodiment, the deformable sensor bore wall is capable of transmitting or exerting the ambient pressure such that the pressure between the exterior surface of the sidewall and the interior chamber of the pressure sensor is substantially balanced or the pressures are substantially equal.

In addition, the sidewall of the interior chamber of the pressure sensor has a sidewall thickness and the deformable sensor bore wall has a deformable sensor bore wall thickness. Preferably, the deformable sensor bore wall thickness is approximately less than or equal to the sidewall thickness. These relative dimensions enhance or facilitate the transmission of the ambient pressure between the sensor bore wall and the sidewall and achievement of the balancing effect. More preferably, the deformable sensor bore wall thickness is less than the sidewall thickness. Further, each of the thicknesses of the sensor bore wall and sidewall are preferably as small as possible. In the preferred embodiment, the sidewall thickness is approximately 1.5 mm, while the deformable sensor bore wall thickness is approximately 1.0 mm. However, the sidewall thickness may be less than approximately 1.5 mm, while the deformable sensor bore wall thickness may be less than approximately 1.0 mm.

As indicated, the sensor sealing mechanism is provided for sealing the pressure sensor relative to the housing and is preferably located adjacent to the first insert end. The sensor sealing mechanism may be comprised of any seal, sealing assembly or sealing mechanism capable of, and suitable for, sealing between the pressure sensor and the housing. Although one or more O-rings may be used, as in conventional pressure sensors, the sensor sealing mechanism preferably does not utilize O-rings as the primary sealing mechanism, although one or more O-rings may be used as a secondary or back-up sealing mechanism if desired. Rather, the sensor sealing mechanism is preferably comprised of a weld between the pressure sensor and the deformable sensor bore wall.

In particular, a butt weld is preferably provided between the sensor bore wall and the sidewall of the pressure sensor adjacent the sensing end. The weld not only provides a seal but also acts to maintain the pressure sensor in the desired position in the housing within the sensor mount. Further, as a result of the use of a weld as the sensor sealing mechanism, unwanted or undesirable gases detrimental to the electronics assembly are inhibited or prevented from passing within the housing to the interior of the housing on the low pressure side of the insert. As well, inert gases may be contained within the interior of the housing which are inhibited or prevented from passing out of the housing to the exterior of the housing as a result of the weld.

Further, as previously indicated, the housing sealing mechanism is provided for sealing the insert relative to the insert carrier. The housing sealing mechanism may be comprised of any seal, sealing assembly or sealing mechanism capable of, and suitable for, sealing between the housing of the insert and the insert carrier. Although one or more O-rings may be used, the housing sealing mechanism preferably does not utilize O-rings as the primary sealing mechanism, although one or more O-rings may be used as a secondary or back-up sealing mechanism if desired. Rather, the housing sealing mechanism is preferably comprised of a metal seal. Thus, a metal to metal seal is provided between the housing of the insert of the insert carrier. In the preferred embodiment, the metal seal is comprised of a metal crush ring located between the housing and the insert carrier. As the insert is moved in the first direction such that the compatible threads of the insert threaded section and the carrier threaded section are engaged, the crush ring is deformed and crushed between compatible, opposed shoulders on the housing and the insert carrier to provide a metal seal therebetween.

As well, as indicated, the pressure sensor insert is preferably connectable with and removable from the insert carrier without handling the pressure sensor at the first insert end. In addition, the pressure sensor insert is preferably configured to avoid or minimize any accidental or undesirable contact with the pressure sensor. As a result, in the preferred embodiment, the proximal chamber end of the interior chamber of the pressure sensor is located between the first insert end and the first insert mounting component. Further, the housing sealing mechanism is located between the first insert end and the first insert mounting component. Finally, the sensor sealing mechanism is located between the first insert end and the first insert mounting component.

Finally, the electronics assembly is contained within the interior of the housing and electrically connected with the pressure sensor. The electronics assembly is provided for collecting and processing sensed data or information received from the pressure sensor and subsequently storing the data for later retrieval, transmitting the data to the surface or both. Thus, the electronics assembly is preferably comprised of a processor for processing data received from the pressure sensor. Any known or conventional processor may be used which is capable of processing the data received from the pressure sensor and which is suitable for use in the intended downhole application of the insert carrier. Further, the electronics assembly is comprised of a memory for storing data generated by the insert. Any known or conventional memory device may be used which is capable of storing the data and which is suitable for use in the intended downhole application of the insert carrier.

The insert may be comprised of an electrical power source for the electronics assembly. In this case, any suitable electrical power source may be used, such as a battery. However, preferably, an electrical power source is provided externally to the insert, such as by the insert carrier. Accordingly, the pressure sensor insert is preferably further comprised of an electrical connector for electrically connecting the insert with an electrical power source. Although the electrical connector may be located at any position within the housing of the insert, the electrical connector is preferably located adjacent to the second insert end. Thus, following the connection of the insert with the insert carrier, the electrical power source may be readily connected with the electrical connector at the second insert end.

SUMMARY OF DRAWINGS

Embodiments of the invention will now be described with reference to the accompanying drawings, in which.

DETAILED DESCRIPTION

Figure 1:
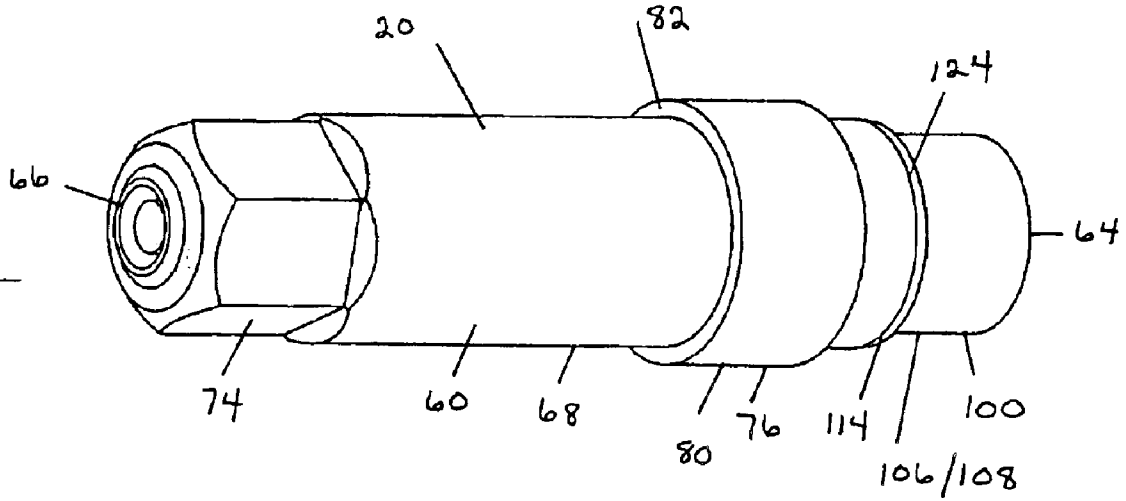
FIG. 1 is a pictorial view of a preferred embodiment of a replaceable pressure sensor insert of the within invention provided for removable connection with an insert carrier.
Figure 2:
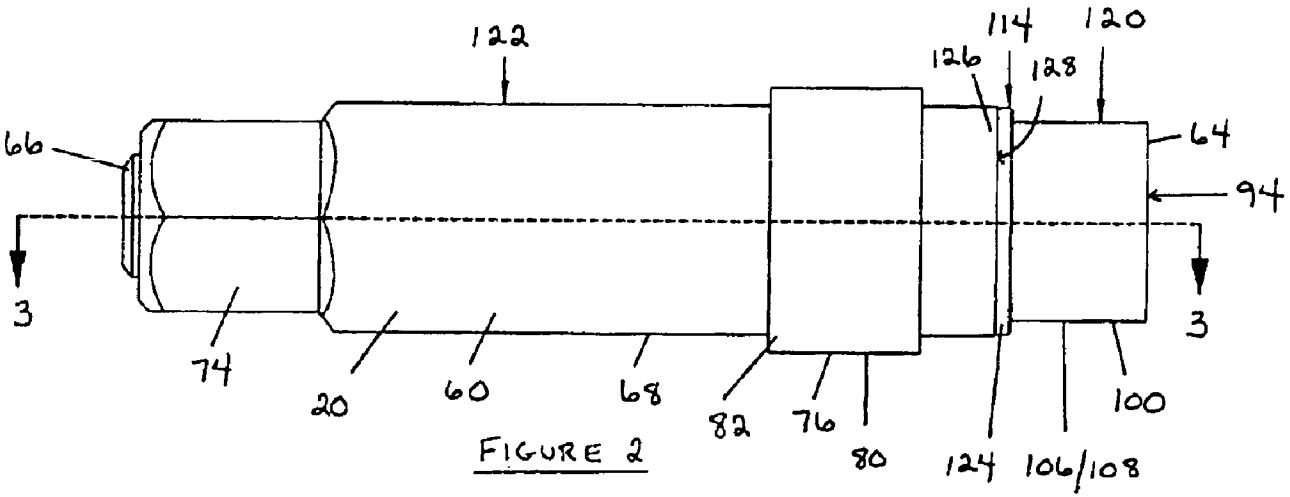
FIG. 2 is a side view of the pressure sensor insert shown in FIG. 1.
Figure 3:
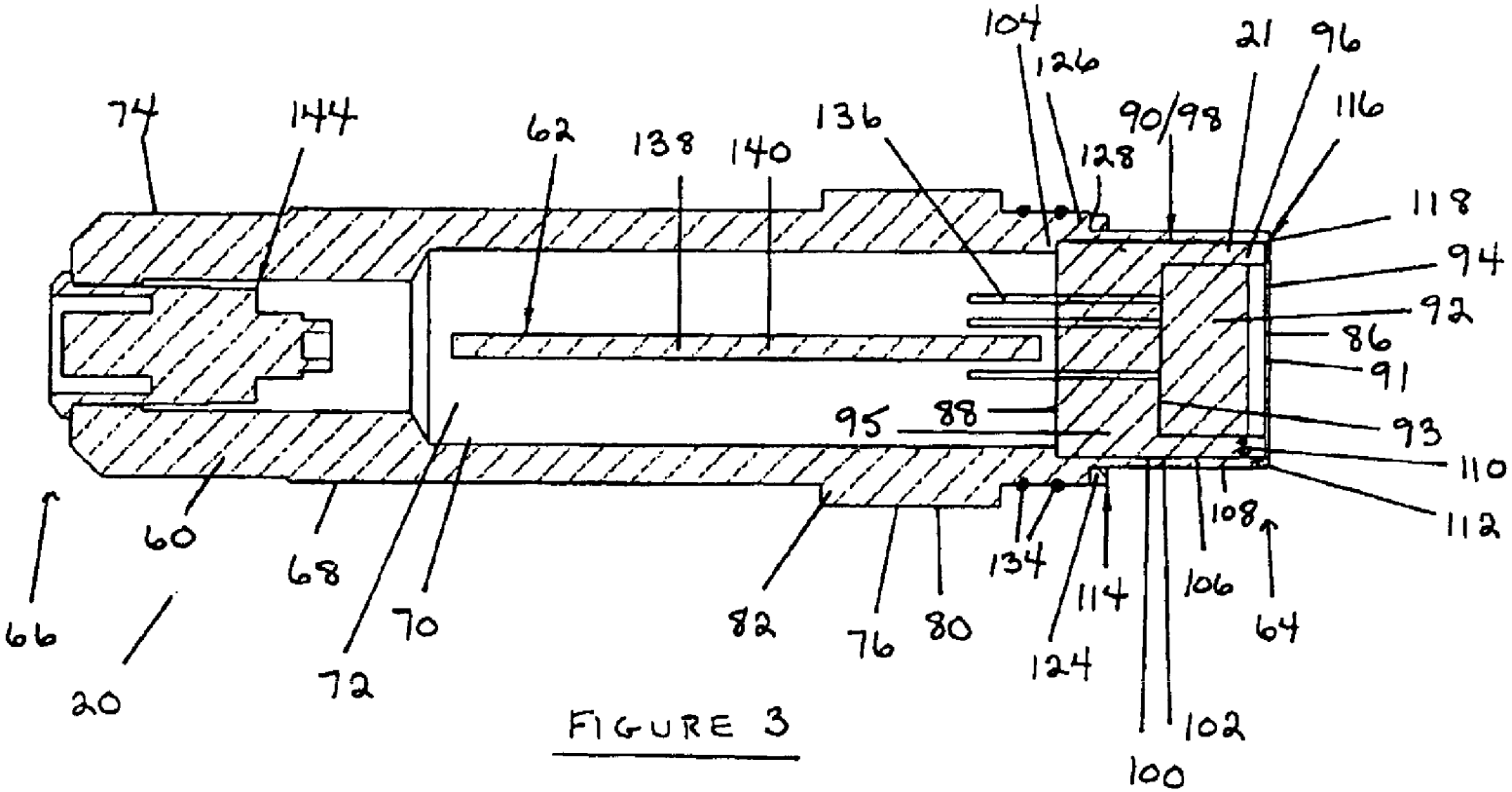
FIG. 3 is a longitudinal sectional view of the pressure sensor insert taken along lines 3—3 of FIG. 2.
Figure 5:
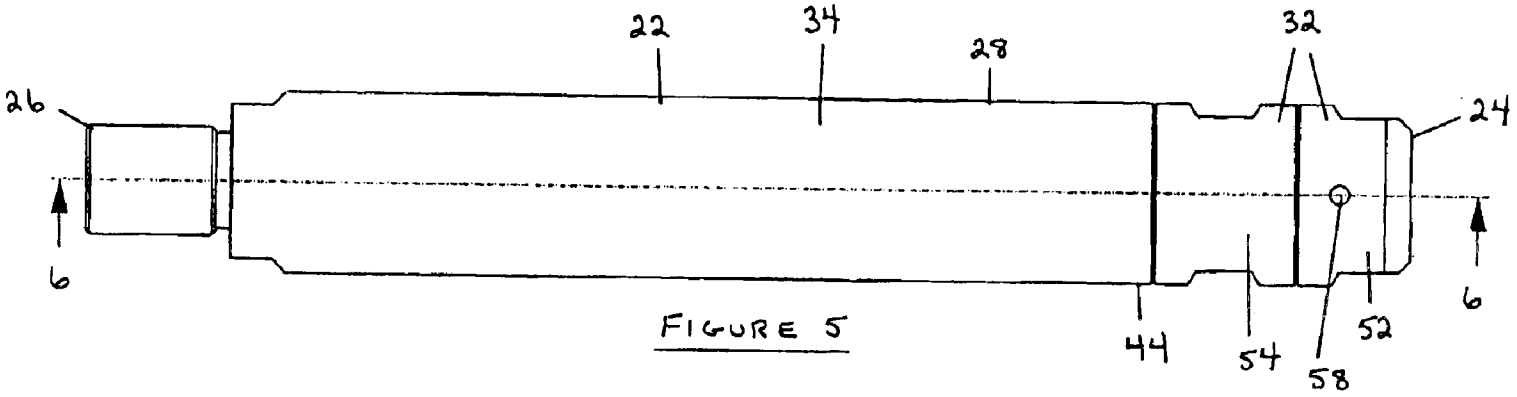
FIG. 5 is a side view of the pressure sensor insert and insert carrier shown in FIG. 4.
Figure 4:
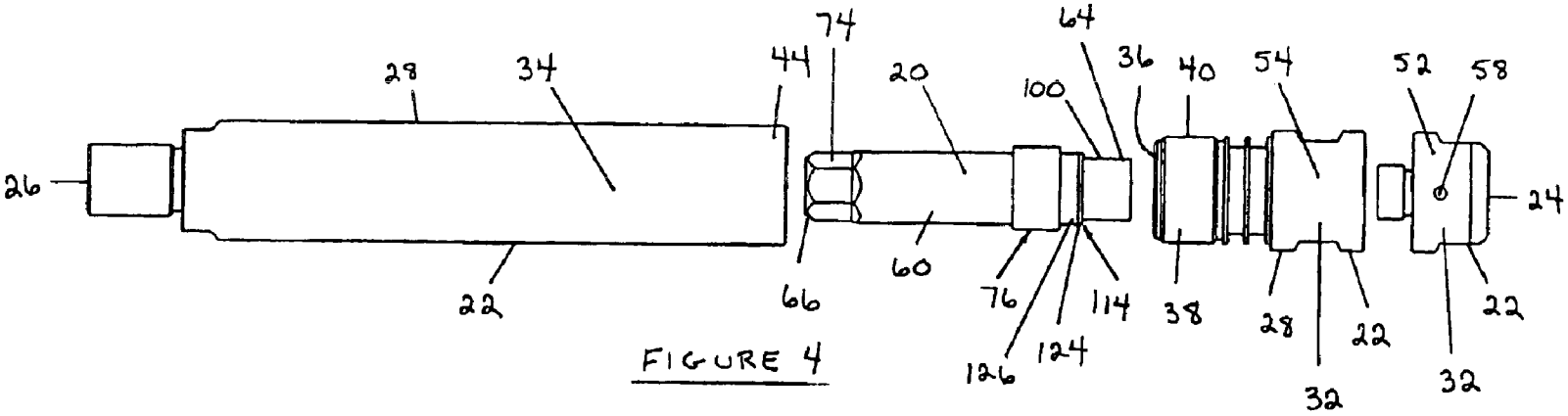
FIG. 4 is an exploded pictorial view of the pressure sensor insert shown in FIG. 1 connected with the insert carrier.

Referring to FIGS. 1–6, the present invention relates to a replaceable pressure sensor insert (20) comprised of a pressure sensor (21) for sensing ambient pressure, wherein the pressure sensor insert (20) is removably connectable with an insert carrier (22), as particularly shown in FIGS. 3–6. The insert carrier (22) may comprise all or a portion of any downhole drilling or production tool, apparatus or sub assembly where the use of a pressure sensor is required or desired for the particular operation being conducted. In other words, the downhole tool apparatus or sub assembly is comprised, at least in part, of the insert carrier (22). In the preferred embodiment, the downhole tool apparatus or sub assembly is comprised of the insert carrier (22) which is received within or connected with one or more further components, members or elements of the downhole tool apparatus or sub assembly.

Referring to FIGS. 3–6, the insert carrier (22) has a first carrier end (24) and a second carrier end (26) and is comprised of one or more members or elements which extend between the first and second carrier ends (24, 26) and provide a means or mechanism for removably connecting the pressure sensor insert (20) therewith. Further, the insert carrier (22) has an external surface (28) which is adapted for, and has a shape or configuration compatible with, connection with the remainder of the further components, members or elements which comprise the downhole tool apparatus or sub assembly. In the preferred embodiment, the insert carrier (22) has an elongate shape or configuration which is substantially or generally circular on cross-section.

The pressure sensor insert (20) may be removably connected with and carried by the insert carrier (22) in any manner and using any connecting means, mechanism or structure capable of removably connecting or mounting the insert (20) with the insert carrier (22). In the preferred embodiment, the insert carrier (22) further defines a carrier chamber (30) therein for receiving the pressure sensor insert (20) such that the insert (20) is contained or enclosed within the carrier chamber (30). Thus, the carrier chamber (30) is sized and configured to be compatible with the pressure sensor insert (20) such that the pressure sensor insert (20) is receivable within the carrier chamber (30). In the preferred embodiment, the carrier chamber (30) is substantially or generally circular on cross-section.

More particularly, in the preferred embodiment, the insert carrier (22) is comprised of a first carrier member (32) and a second carrier member (34) which are releasably connected or mounted together to form the complete insert carrier (22) and to define the carrier chamber (30) therein. Specifically, the first carrier member (32) defines the first carrier end (24) and is releasably connectable with the second carrier member (34) which defines the second carrier end (26). The first and second carrier members (32, 34) may be connectable in any manner and by means, mechanism or structure capable of releasably connecting the first and second carrier members (32, 34) such that the first and second carrier members (32, 34) may be released or disconnected to permit the placement of the pressure sensor insert (20) within the carrier chamber (30) and subsequently re-connected to contain the pressure sensor insert (20) therein. In the preferred embodiment, the first and second carrier members (32, 34) are releasably connected by a threaded connection or a threaded engagement of the first and second carrier members (32, 34).

More particularly, the first carrier member (32) extends from the first carrier end (24) to an opposed first engagement end (36). The first engagement end (36) includes a pin portion (36) defining an externally threaded surface (40). Further, the first carrier member (32) defines a first end (42) of the carrier chamber (30) which extends to the first engagement end (36).

Similarly, the second carrier member (34) extends from the second carrier end (26) to an opposed second engagement end (44). The second engagement end (44) includes a box portion (46) defining an internally threaded surface (48) which is compatible with the externally threaded surface (40) of the first carrier member (32). Further, the second carrier member (34) defines a second end (50) of the carrier chamber (30) which extends to the second engagement end (44).

Thus, the first and second carrier members (32, 34) are connected or mounted together by inserting the pin portion (38) of the first carrier member (32) within the box portion (46) of the second carrier member (34) and threadably engaging the externally threaded surface (40) and the internally threaded surface (48) of the pin and box portions (38, 46) respectively. When threaded together, the first end (42) of the carrier chamber (30) communicates with the second end (50) of the carrier chamber (50) such that the complete carrier chamber (30) is defined within the insert carrier (22).

Each of the first and second carrier members (32, 34) may be comprised of a single integral member or component or may be comprised of two or more members or components fixedly or releasably connected together to form or provide the carrier member (32, 34). In the preferred embodiment, the second carrier member (34) is comprised of a single integral member or component. The first carrier member (32) is comprised of two members or components releasably connected or fastened together. In particular, a bull nose portion (52) defining the first carrier end (24) is sealingly engaged with a housing portion (54) defining the first engagement end (36) and defining the first end (42) of the carrier chamber (30) therein. In the preferred embodiment, a threaded connection is provided between the bull nose and housing portions (52, 54) which is sealed with one or more O-rings, seals or sealing assemblies (56) located therebetween.

If desired or required, one or more O-rings, seals or sealing assemblies (56) may also be positioned or located between the first and second carrier members (32, 34) in order to seal the first carrier member (32) relative to the second carrier member (34) such that the carrier chamber (30) may be sealed from the ambient environment exterior to the insert carrier (22). Although the first carrier member (32) may be sealed relative to the second carrier member (34) in any manner, in the preferred embodiment, one or more seals (56) are positioned between the pin portion (38) of the first carrier member (32) and the box portion (46) of the second carrier member (34), preferably adjacent the engagement of the threaded surfaces (40, 48).

Finally, as indicated, the pressure sensor insert (20) is contained within the carrier chamber (30). Thus, in order to permit the sensing of the ambient pressure and operation of the pressure sensor insert (20), the ambient pressure must be able to be communicated from exterior the insert carrier (22) to the pressure sensor insert (20) within the carrier chamber (30). In the preferred embodiment, for this purpose, the first carrier member (32) defines at least one port (58) or passage therethrough which extends from the external surface (28) of the insert carrier (22) to the first end (42) of the carrier chamber (30). In the preferred embodiment, at least one port (58) or passage extends from the external surface (28) of the insert carrier (22) at the bull nose portion (52), through the bull nose portion (52) and the housing portion (54) to the first end (42) of the carrier chamber (30) within the housing portion (54).

As indicated, the replaceable pressure sensor insert (20) is adapted or configured to be removably connected with the insert carrier (22). Thus, the pressure sensor insert (20) may be readily placed within and removed from the insert carrier (22) to meet the particular pressure sensor (21) requirements of a particular downhole application or operation or to repair or replace a damaged or faulty pressure sensor (21). In other words, the pressure sensor insert (20) is replaceable in that it is adapted to be removably or releasably connected with the insert carrier (22). Preferably, the pressure sensor insert (20) is readily, or relatively easily, connected with and removed from the insert carrier (22).

In the preferred embodiment, the pressure sensor insert (20) is comprised of a housing (60), the pressure sensor (21)

which is connected with the housing (60) such that the pressure sensor (21) is capable of sensing an ambient pressure exterior to the housing (60) and an electronics assembly (62) electrically connected with the pressure sensor (21). The pressure sensor (21) may be of any type or rating which is compatible with the intended use of the insert carrier (22) including the anticipated downhole conditions. More particularly, the pressure sensor (21) may be comprised of any compatible conventional or known pressure sensor or transducer.

The insert (20) has a first insert end (64) and a second insert end. (66). The housing (60) extends between and defines the first and second insert ends (64, 66). Further, the housing has an exterior (68) and an interior (70) defining a housing chamber (72) extending through the length of the housing (60) between the first and second insert ends (64, 66). The housing (60) may have any size, shape and configuration compatible with the carrier chamber (30) such that the housing (60) is receivable therein for connection with the insert carrier (22). Further, the exterior (68) of the housing (60) may be adapted to accept a label or other information such as a serial number for the insert (20) or the pressure or temperature rating of the pressure sensor (21).

In the preferred embodiment, the housing (60) is comprised of an elongate tubular member defining the exterior and interior (68, 70) of the housing (60) and is preferably substantially or generally circular on cross-section. Finally, in the preferred embodiment, the cross-sectional diameter of the exterior (68) of the housing (60) is about 1 inch (2.54 cm). The housing (60) is preferably comprised of a single integral member or component as described. However, alternately, the housing (60) may be comprised of two or more members or components fixedly or releasably connected together to form or provide the housing (60).

The pressure sensor (21) may be connected with the housing (60) in any manner and at any location along the length of the housing (60) provided that the pressure sensor (21) is capable of sensing an ambient pressure at the exterior (68) of the housing (60). Preferably, as described further below, at least a portion of the pressure sensor (21) is contained within the interior (70) of the housing (60). In the preferred embodiment, the entire pressure sensor (21) is contained or housed within the housing chamber (72). Further, the pressure sensor (21) is preferably located at, adjacent or in proximity to the first insert end (64).

This configuration is desirable so that the pressure sensor insert (20) may be connected with and disconnected from the insert carrier (22) without the need to handle or contact the pressure sensor (21). More particularly, the pressure sensor (21) is located adjacent to the first insert end (64) and the insert (20) and the insert carrier (22) are configured so that the insert (20) is connected with the insert carrier (22) by advancing the insert (20) relative to the insert carrier (22) in a direction toward the first insert end (64) and is disconnected from the insert carrier (22) by retreating or withdrawing the insert (20) relative to the insert carrier (22) in an opposed direction toward the second insert end (66).

Thus, the pressure sensor insert (20) may be handled manually or through use of a tool or device solely at or adjacent to the second insert end (66). Thus, the pressure sensor insert (20) is preferably further comprised of a tool engagement surface (74) located at, adjacent or in proximity to the second insert end (66). In the preferred embodiment, the tool engagement surface (74) is defined by the exterior (68) of the housing (60) adjacent the second insert end (66) and is adapted to engage a tool for advancing and retreating the insert (20) relative to the insert carrier (22). Although the tool engagement surface (74) may have any shape or configuration compatible for use with the tool to be used, the tool engagement surface (74) is preferably comprised of a hexagonal surface adapted to engage a wrench.

In addition, in order to facilitate the connection and disconnection of the pressure sensor insert (20) within the insert carrier (22), the pressure sensor insert (20) is further comprised of a first insert mounting component (76) adapted to be removably connectable with a second insert mounting component (78) associated with the insert carrier (22). In the preferred embodiment, the first insert mounting component (76) is comprised of an insert threaded section (80) associated with the housing (60). More particularly, a portion of the exterior (68) of the housing (60) between the first and second insert ends (64, 66) defines the insert threaded section (80). Preferably, the insert threaded section (80) is nearer the first insert end (64) than the second insert end (66), although it may be located at any position therebetween. Further, the insert threaded section (80) is preferably particularly comprised of a projecting flange (82) extending or projecting outwardly from the exterior (68) of the housing (60) about the circumference of the housing (60). A thread is then formed or provided within the projecting flange (82) to define the insert threaded section (80).

Similarly, the second insert mounting component (76) is comprised of a carrier threaded section (84) associated with the insert carrier (22) which is compatible for engagement with the insert threaded section (80). More particularly, a portion of the internal carrier chamber (30) of the insert carrier (22) between the first and second ends (42, 50) of the carrier chamber (30) defines the carrier threaded section (84). Preferably, the carrier threaded section (84) is nearer the first end (42) of the carrier chamber (30) than the second end (50), although it may be located at any position therebetween. In the preferred embodiment, the carrier threaded section (84) is defined by the portion of the carrier chamber (30) within the first carrier member (32), and particularly within the housing portion (54), adjacent the first engagement end (36). In other words, the carrier threaded section (84) is defined by a thread, compatible with the thread of the insert threaded section (80), formed or provided within the pin portion (38) of the first carrier member (32).

Accordingly, in the preferred embodiment, the pressure sensor insert (20) is connected with the insert carrier (22) by carrying out the following steps. First, the insert carrier (22) is handled through the engagement of a wrench with the compatible tool engagement surface (74) at the second insert end (66). Second, the insert (20) is advanced relative to the first engagement end (36) of the first carrier member (32) of the insert carrier (22) in the direction toward the first insert end (64). More particularly, the first insert end (64) is configured to be received within the first end (42) of the carrier chamber (30). The insert (22) is advanced longitudinally in the direction toward the first insert end (64) until the insert threaded section (80) contacts or abuts the carrier threaded section (84) within the pin portion (38) of the first carrier member (32).

Third, the insert (20) is rotated relative to the first carrier member (32) in a first direction such that the compatible threads of the insert threaded section (80) and the carrier threaded section (84) are engaged and such that the insert (20) advances relative to the first carrier member (32) in the direction toward the first insert end (64). Once the threaded sections (80, 84) are fully engaged, the second carrier member (34) is connected with the first carrier member (32) such that the second insert end (66) extends within the carrier chamber (30) towards the second end (50) of the carrier chamber (30). In particular, the box portion (46) at the second engagement end (44) of the second carrier member (34) is threadably engaged with the pin portion (38) at the first engagement end (36) of the first carrier member (32).

The pressure sensor insert (20) is disconnected from the insert carrier (22) by reversing these steps. First, the second carrier member (34) is disconnected from the first carrier member (32) by threadably disengaging the box portion (46) at the second engagement end (44) of the second carrier member (34) from the pin portion (38) at the first engagement end (36) of the first carrier member (32). Second, the insert (20) is rotated relative to the first carrier member (32) in a second direction opposed to the first direction such that the compatible threads of the insert threaded section (80) and the carrier threaded section (84) are disengaged and such that the insert (20) retreats relative to the first carrier member (32) in the direction toward the second insert end (66). Finally, the insert (20) is retreated or moved longitudinally relative to the first engagement end (36) of the first carrier member (32) of the insert carrier (22) in the direction toward the second insert end (66). In other words, the insert threaded section (80) is moved away from the carrier threaded section (84) such that the first insert end (64) is withdrawn from the pin portion (38) of the first carrier member (32).

As stated, the pressure sensor (21) may be connected with the housing (60) in any manner provided that the pressure sensor (21) is capable of sensing an ambient pressure at the exterior (68) of the housing (60). However, in the preferred embodiment, the pressure sensor (21) is rigidly or fixedly connected with the housing (60) such that the pressure sensor (21) may not be readily removed therefrom. More particularly, the pressure sensor (21) is preferably connected with the housing (60) at, adjacent or in proximity to the first insert end (64) by welding the sensor (21) with the housing (60) as discussed further below.

In the preferred embodiment, the pressure sensor (21) is comprised of a sensing end (86) for sensing the ambient pressure at the exterior (68) of the housing (60) and a connecting end (88) for electrically connecting the pressure sensor (21) with the electronics assembly (62). As well, the pressure sensor (21) defines an exterior (90) of the pressure sensor (21) extending between the sensing and connecting ends (86, 88) and further defines an interior chamber (92) extending to the sensing end (86) of the pressure sensor (21). More particularly, the interior chamber (92) of the pressure sensor (21) is comprised of a distal chamber end (91) adjacent to the sensing end (86) of the pressure sensor (21) and an opposed proximal chamber end (93) positioned between the sensing and connecting ends (86, 88) of the pressure sensor (21).

The proximal chamber end (93) is positioned between the sensing and connecting ends (86, 88) to provide an inner wall (95) of the pressure sensor (21) having a thickness defined between the proximal chamber end (93) and the connecting end (88) of the pressure sensor (21). The thickness of the inner wall (95) is selected such that the inner wall (95) is substantially unaffected or undeformed by the exertion or application of the ambient pressure within the interior chamber (92). As minimal, if any, deformation occurs to the inner wall (95), balancing of the ambient pressure applied to or exerted upon the proximal chamber end (93) is not required.

The connecting end (88) of the pressure sensor (21) is in communication with the interior (70) of the housing (60) in order to facilitate the electrical connection of the pressure sensor (21) and the electronics assembly (62). The sensing end (86) of the pressure sensor (21) is comprised of a diaphragm (94) which extends across the interior chamber (92) of the pressure sensor (21) at the distal chamber end (91). The pressure sensor (21) is positioned within the insert (20) such that the diaphragm (94) is in communication with the exterior (68) of the housing (60) when the insert (20) is connected with the insert carrier (22) so that the ambient pressure at the exterior (68) of the housing (60) is transmitted to the interior chamber (92) of the pressure sensor (21). The sensed pressure is then communicated to the electronics assembly (62). The interior chamber (92) preferably contains a fluid therein to facilitate the transmission of the ambient pressure within the interior chamber (92).

More particularly, when the insert (20) is connected with the insert carrier (22), the first insert end (66) is positioned within the first end (42) of the carrier chamber (30). As indicated, the pressure sensor (21) is preferably located adjacent the first insert end (66), and more particularly, the sensing end (86) of the pressure sensor (21), including the diaphragm (94), is located adjacent the first insert end (64). In addition, the port (58) from the external surface (28) of the insert carrier (22) extends to and communicates with the first end (42) of the carrier chamber (30). Thus, ambient pressure external to the insert carrier (22) is communicated through the port (58) to the carrier chamber (30) external to the housing (60) of the insert (20) at the first insert end (64). Accordingly, the ambient pressure at the exterior (68) of the housing (60) adjacent the first insert end (64) is in communication with the diaphragm (94) such that the ambient pressure may be transmitted to the interior chamber (92) of the pressure sensor (21).

In the preferred embodiment, the pressure within the interior chamber (92) of the pressure sensor (21) is balanced, at least in part, or counteracted by a pressure applied to or exerted on the exterior (90) of the pressure sensor (21). More particularly, the ambient pressure is preferably applied to the pressure sensor (21) from opposed directions from within the interior chamber (92) of the pressure sensor (21) and from the exterior (90) of the pressure sensor (21) adjacent the interior chamber (92) to achieve a pressure balancing effect.

More particularly, the pressure sensor (21) is preferably further comprised of a sidewall (96) surrounding the interior chamber (92) of the pressure sensor (21). The sidewall (96) is comprised of an exterior surface (98) which is defined by a portion of the exterior (90) of the pressure sensor (21). Thus, in the preferred embodiment, at least a portion of the ambient pressure is exerted on the exterior surface (98) of the sidewall (96) in order to provide a balancing of pressure between the exterior surface (98) of the sidewall (96) and the interior chamber (92) of the pressure sensor (21).

Further, the pressure sensor (21) may be connected or mounted with the housing (60) in any manner permitting the desired exposure of the sidewall (96) surrounding the interior chamber (92) to the ambient pressure. In the preferred embodiment, the housing (60) is comprised of a sensor mount (100) for mounting the pressure sensor (21). Preferably, the sensor mount (100) is comprised of a portion of the housing (60) at the first insert end (64), and in particular, is comprised of a portion or section of the housing chamber (72) adjacent the first insert end (64). However, the sensor mount (100) may be comprised of a separate member which is affixed or mounted with the housing (60) to form an integral component of the housing (60) defining the first insert end (64).

In any event, the sensor mount (100) preferably defines a sensor bore (102) for accepting and positioning of the pressure sensor (21) therein. Further, the sensor bore (102) preferably defines a sensor mount shoulder (104) facing towards the first insert end (64) for engagement with the pressure sensor (21). In particular, when the pressure sensor (21) is positioned with the sensor mount (100), the connecting end (88) of the pressure sensor (21) abuts against the sensor mount shoulder (104) to prevent or inhibit further movement of the pressure sensor (21) within the housing chamber (72) in the direction of the second insert end (66).

In addition, the sensor mount (100) is preferably further comprised of a sensor bore wall (106) surrounding the sensor bore (102). In the preferred embodiment, the sidewall (96) surrounding the interior chamber (92) of the pressure sensor (21) is substantially contained within the sensor bore (102) comprising the sensor mount (100). More particularly, the sidewall (96) is substantially contained within the sensor bore wall (106) surrounding the sensor bore (102).

In the preferred embodiment, any space or gap between the adjacent surfaces of the sidewall (96) surrounding the interior chamber (92) and the sensor bore wall (106) is minimized. Preferably, a space or gap of about 0.001 inches (0.00254 cm) is provided. In other words, a friction fit is preferably provided between the sidewall (96) and the sensor bore wall (106).

In the preferred embodiment, the desired pressure balancing effect is achieved primarily or substantially through an indirect exposure of the sidewall (96) to the ambient pressure. More particularly, the exterior surface (98) of the sidewall (96) of the interior chamber (92) of the pressure sensor (21) is indirectly exposed to the ambient pressure by transmission or application of the ambient pressure through the adjacent sensor bore wall (106). Thus, the thickness of, and material comprising, the sensor bore wall (106) are selected such that the ambient pressure is applied exteriorly to the sensor bore wall (106) and transmitted through the sensor bore wall (106) to the adjacent exterior surface (98) of the sidewall (96) to substantially balance the ambient pressure transmitted to the interior chamber (92) through the diaphragm (94). The friction fit provided between the sidewall (96) and the sensor bore wall (106) enhances or facilitates the transmission or communication of the pressure therebetween.

In order to further enhance or facilitate this indirect transmission or communication of the ambient pressure, the sensor bore wall (106) is comprised of a relatively thin, compressible or deformable material. Thus, in the preferred embodiment, the sensor bore wall (106) is comprised of a deformable sensor bore wall (108). As defined herein, the sensor bore wall (106) is considered to be a deformable sensor bore wall (108) where, upon the exterior exposure of the sensor bore wall (106) to the ambient pressure, the sensor bore wall (106) is capable of transmitting at least a portion of the ambient pressure to, or exerting at least a portion of the ambient pressure on, the exterior surface (98) of the sidewall (96) such that at least a partial balancing effect of the pressure may be achieved between the exterior surface (98) of the sidewall (96) and the interior chamber (92) of the pressure sensor (21). In the preferred embodiment, the deformable sensor bore wall (108) is capable of transmitting or exerting the ambient pressure such that the pressure between the exterior surface (98) of the sidewall (96) and the interior chamber (92) of the pressure sensor (21) is substantially balanced or the pressures are substantially equal. In the preferred embodiment, the ambient pressure is typically greater than about 3000 psi.

In the preferred embodiment, the housing (60), including the deformable sensor bore wall (108), is comprised of stainless steel or an alternate corrosion-resistant metal alloy suitable for and compatible with the intended use or application of the pressure sensor insert (20), such as Inconel™ or Hastelloy™. Further, the pressure sensor (21) is preferably comprised of a similar material to that of the housing (60).

In addition, the sidewall (96) surrounding the interior chamber (92) of the pressure sensor (21) has a sidewall thickness (110) and the deformable sensor bore wall (108) has a deformable sensor bore wall thickness (112). The relative thicknesses are selected to enhance or facilitate the transmission or communication of pressures between the sidewall (96) and the deformable sensor bore wall (108). However, preferably, the deformable sensor bore wall thickness (112) is approximately less than or equal to the sidewall thickness (110). These relative dimensions have been found to particularly enhance or facilitate the transmission of the ambient pressure between the deformable sensor bore wall (108) and the sidewall (96) and the achievement of the balancing effect. More preferably, the deformable sensor bore wall thickness (112) is less than the sidewall thickness (110). In the preferred embodiment, the sidewall thickness (110) is approximately 1.5 mm, while the deformable sensor bore wall thickness (112) is approximately 1.0 mm.

Further, the pressure sensor insert (20) is comprised of a housing sealing mechanism (114) and a sensor sealing mechanism (116). The housing sealing mechanism (114) is provided for sealing the insert (20) relative to the insert carrier (22), while the sensor sealing mechanism (116) is provided for sealing the pressure sensor (21) relative to the housing (60). Preferably, the housing sealing mechanism (114) and the sensor sealing mechanism (116) are positioned such that the proximal chamber end (93) of the interior chamber (92) of the pressure sensor (21) is located between the first insert end (64) and at least one of the housing sealing mechanism (114) and the sensor sealing mechanism (116).

The sensor sealing mechanism (116) may be positioned at any location along the exterior (90) of the pressure sensor (21) between the exterior (90) of the pressure sensor (21) and the adjacent sensor bore (102). The sensor sealing mechanism (116) is particularly provided to seal the pressure sensor (21) relative to the housing (60) and thus facilitate the sealing of the interior (70) of the housing (60) from the exterior environment. As a result, the electronics assembly (62) contained within the housing chamber (72) may be sealed or enclosed within the housing (60).

More particularly, the sensor sealing mechanism (116) may be located at any position along the exterior (90) of the pressure sensor (21) between the sensing end (86) and the connecting end (88). However, in the preferred embodiment, the sensor sealing mechanism (116) is located adjacent to the first insert end (64). More particularly, the sensor sealing mechanism (116) is located at, adjacent or in proximity to the sensing end (86) of the pressure sensor (21) for ease of access thereto and such that any space or gap between the sensor bore wall (106) and the adjacent exterior (90) of the pressure sensor (21) is sealed from the ambient pressure.

Thus, the proximal chamber end (93) of the interior chamber (92) is located between the sensor sealing mechanism (116) and the second insert end (66). As a result, in order to permit the indirect transmission of the ambient pressure by permitting the exposure of the sensor bore wall (106) thereto, the housing sealing mechanism (114) is required to be positioned such that the proximal chamber end (93) of the interior chamber (92) is located between the first insert end (64) and the housing sealing mechanism (114). Thus, the exterior (68) of the sensor bore wall (106) is exposed to the ambient pressure.

Although the sensor sealing mechanism (116) may be comprised of any seal, sealing assembly or sealing mechanism capable of, and suitable for, sealing between the pressure sensor (21) and the housing (60), in the preferred embodiment, the sensor sealing mechanism (116) is preferably comprised of a weld (118) between the pressure sensor (21) and the deformable sensor bore wall (108). In particular, a butt weld (118) is provided between the deformable sensor bore wall (108) and the sidewall (96) of the pressure sensor (21) about the perimeter or circumference of the sensing end (86) of the pressure sensor (21). The weld (118) provides the sensor sealing mechanism (116) and also assists with maintaining the pressure sensor (21) in the desired position in the housing (60) within the sensor mount (100). Thus, the pressure sensor (21) is held in position between the weld (118) at the sensing end (86) and the sensor mount shoulder (104) at the connecting end (88).

Further, the use of the weld (118) also inhibits or prevents the passage of any unwanted or undesirable gases through the sensor sealing mechanism (116) and into the interior (70) of the housing (60), which gases may be detrimental to the electronics assembly (62) therein. As well, the weld (118) permits desirable inert gases to be contained within the interior (70) of the housing (60) as the gases are inhibited or prevented from passing out of the housing (60) to the exterior (68) of the housing (60) through the sensor sealing mechanism (116). For instance, the interior (70) of the housing (60) may contain inert gases which assist in protecting the electronics assembly (62) from oxidation at higher temperatures.

Positioning of the weld (118) at the sensing end (86) of the pressure sensor (21) has been found to be more advantageous than positioning of the weld (118) nearer to the connecting end (88). In particular, positioning of the weld (118) at the sensing end (86) may expose the weld (118) to less stress as the sensing end (86) is typically exposed to less stress and the deformable nature of the sensor bore wall (106) puts let stress on the weld (118) when temperature or pressure are applied.

The housing sealing mechanism (114) provides a seal between the exterior (68) of the housing (60) of the insert (20) and the carrier chamber (30) of the insert carrier (22). In the preferred embodiment, referring to FIG. 2, the insert (20) has a high pressure side (120) which is exposed to the ambient pressure and a low pressure side (122) which is sealed from the ambient pressure. Preferably, the housing sealing mechanism (114) defines the high and low pressure sides (120, 122) of the insert (20). The high pressure side (120) which is exposed to the ambient pressure is defined by the portion of the insert (20) between the first insert end (64) and the housing sealing mechanism (114). The low pressure side (122) of the insert (20) which is sealed from the ambient pressure is defined by the portion of the insert (20) between the second insert end (66) and the housing sealing mechanism (114). Thus, in the preferred embodiment, the interior chamber (92) is entirely located within the high pressure side (120) of the insert (20).

Figure 6:
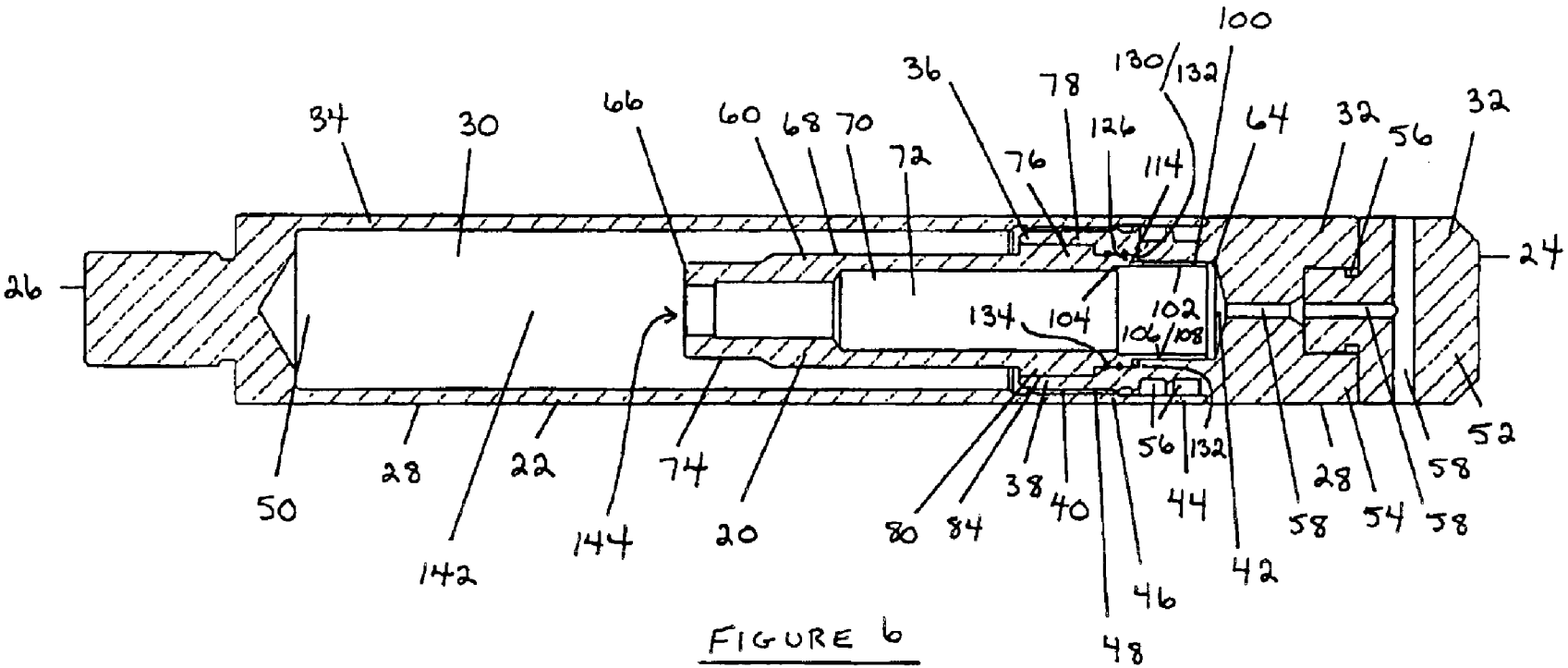
FIG. 6 is a longitudinal sectional view of the pressure sensor insert and insert carrier taken along lines 6—6 of FIG. 5.

Although the housing sealing mechanism (114) may be comprised of any seal, sealing assembly or sealing mechanism, the housing sealing mechanism (114) is preferably comprised of a metal seal between the housing (60) of the insert (20) and the insert carrier (22). In the preferred embodiment, the metal seal is comprised of a metal crush ring (124). As shown in FIG. 6, the exterior (68) of the sensor bore wall (106) adjacent the connecting end (88) of the pressure sensor (21) defines a first shoulder (126) providing a first crushing surface (128) facing towards the first insert end (64) for engagement with the metal crush ring (124). Similarly, the first end (42) of the carrier chamber (30) of the insert carrier (22) within the first carrier member (32) defines a second shoulder (130) providing a second crushing surface (132), opposed to the first crushing surface (128), for engagement with the metal crush ring (124). Thus, as the insert (20) is moved in the first direction such that the compatible threads of the insert threaded section (80) and the carrier threaded section (84) are engaged, the metal crush ring (124) is deformed and crushed between the opposed first and second crushing shoulders (128, 132) to provide the metal seal therebetween. Further, where desired, one or more O-rings (134) may be used as a secondary or back-up sealing mechanism if desired.

As indicated, the pressure sensor insert (20) is preferably connectable with and removable from the insert carrier (22) without handling the pressure sensor (21) at the first insert end (64). In addition, the pressure sensor insert (21) is configured to avoid or minimize any accidental or undesirable contact with the pressure sensor (21). As a result, in the preferred embodiment, the proximal chamber end (93) of the interior chamber (92) of the pressure sensor (21) is located between the first insert end (64) and the first insert mounting component (76). Further, the housing sealing mechanism (114) is located between the first insert end (64) and the first insert mounting component (76)t. Finally, the sensor sealing mechanism (116) is also located between the first insert end (64) and the first insert mounting component (76).

The electronics assembly (62) is contained within the interior (70) of the housing (60) and is electrically connected with the pressure sensor (21). Any suitable mechanism, structure or components may be used to electrically connect the pressure sensor (21) with the electronics assembly (62) such that data or information sensed by the pressure sensor (21) may be communicated to the electronics assembly (62). In the preferred embodiment, one or more electrical connectors (136) extend between the pressure sensor (21) and the electronics assembly (62) through "glass feed-throughs" or glass encased passages extending from the proximal chamber end (93) of the interior chamber (92) through the connecting end (88) of the pressure sensor (21).

The electronics assembly (62) is provided for collecting and processing sensed data or information received from the pressure sensor (21) and subsequently storing the data for later retrieval, transmitting the data to the surface or both. In the preferred embodiment, the electronics assembly (62) is comprised of a processor (138) including a printed circuit board for processing data received from the pressure sensor (21). Any known or conventional processor (138) may be used which is capable of processing the data received from the pressure sensor (21) and which is suitable for use in the intended downhole application of the insert carrier (22). Further, in the preferred embodiment, the electronics assembly (62) is comprised of a memory (140) for storing data generated by the insert (22). The memory (140) may be comprised of any known or conventional memory device capable of storing the data and which is suitable for use in the intended downhole application of the insert carrier (22).

Finally, the electronics assembly (62) requires an electrical power source (142) which may be contained within the insert (20) itself, within the insert carrier (22) or within a further component of the downhole drilling or production apparatus or tool. For instance, the insert (20) may be comprised of an electrical power source (142) for the electronics assembly (62) contained within the housing chamber (72) adjacent the second insert end (66). In this case, any suitable electrical power source (142) may be used, such as a battery.

However, in the preferred embodiment, the insert carrier (22) is comprised of the electrical power source (142). Preferably, the electrical power source (142), such as a battery, in contained or positioned within the carrier chamber (30), preferably within the second carrier member (34) adjacent the second end (50) of the carrier chamber (30). As a result, the pressure sensor insert (20) is further comprised of an electrical connector (144) for the power source (142) which electrically connects the electronics assembly (62) with the electrical power source (142). The power source electrical connector (144) is therefore located adjacent to the second insert end (66).

What is claimed is:

1. A replaceable pressure sensor insert adapted for removable connection with an insert carrier, the pressure sensor insert comprising:

(a) a housing, wherein the housing defines an exterior and an interior;

(b) a pressure sensor connected with the housing such that the pressure sensor is capable of sensing an ambient pressure at the exterior of the housing, wherein the pressure sensor defines an exterior and an interior chamber, (c) an electronics assembly contained within the interior of the housing and electrically connected with the pressure sensor;

(d) a first insert mounting component adapted to be removably connectable with a second insert mounting component associated with the insert carrier in order to facilitate connection and replacement of the insert;

(e) a housing sealing mechanism for sealing the insert relative to the insert carrier; and (f) a sensor sealing mechanism for sealing the pressure sensor relative to the housing (g) wherein the pressure sensor is comprised of:

(i) a sensing end for sensing the ambient pressure at the exterior of the housing, wherein the sensing end is comprised of a diaphragm for transmitting the ambient pressure from the exterior of the pressure sensor to the interior chamber of the pressure sensor, and wherein the diaphragm is in communication with the exterior of the housing so that the ambient pressure at the exterior of the housing is transmitted to the interior chamber of the pressure sensor; and (ii) a connecting end for electrically connecting the pressure sensor with the electronics assembly, wherein the connecting end of the pressure sensor is in communication with the interior of the housing in order to facilitate the electrical connection of the pressure sensor and the electronics assembly.

2. The insert as claimed in claim 1 wherein the electronics assembly is comprised of a processor for processing data received from the pressure sensor.

3. The insert as claimed in claim 1 wherein the electronics assembly is comprised of a memory for storing data generated by the insert.

4. The insert as claimed in claim 1 wherein the pressure sensor is further comprised of a sidewall surrounding the interior chamber of the pressure sensor, wherein the sidewall is comprised of an exterior surface, and wherein the insert is configured so that at least a portion of the ambient pressure is exerted on the exterior surface of the sidewall in order to provide a balancing of pressure between the exterior surface of the sidewall and the interior chamber of the pressure sensor.

5. The insert as claimed in claim 4 wherein the housing is comprised of a sensor mount which defines a sensor bore for accepting the pressure sensor, wherein the sensor mount is comprised of a sensor bore wall surrounding the sensor bore, and wherein the pressure sensor is positioned within the sensor bore.

6. The insert as claimed in claim 5 wherein the insert is comprised of a first insert end and a second insert end, wherein the sensing end of the pressure sensor is located adjacent to the first insert end, wherein the interior chamber of the pressure sensor is comprised of a distal chamber end adjacent to the sensing end of the pressure sensor, wherein the interior chamber of the pressure sensor is further comprised of a proximal chamber end, and wherein the proximal chamber end is located between the first insert end and at least one of the housing sealing mechanism and the sensor sealing mechanism.

7. The insert as claimed in claim 6 wherein the sidewall of the interior chamber of the pressure sensor is substantially contained within the sensor bore.

8. The insert as claimed in claim 7 wherein the sensor bore wall is comprised of a deformable sensor bore wall.

9. The insert as claimed in claim 8 wherein the sensor sealing mechanism is located adjacent to the first insert end.

10. The insert as claimed in claim 9 wherein the sensor sealing mechanism is comprised of a weld between the pressure sensor and the deformable sensor bore wall.

11. The insert as claimed in claim 10 wherein the housing sealing mechanism is comprised of a metal seal.

12. The insert as claimed in claim 11 wherein the sidewall of the interior chamber of the pressure sensor has a sidewall thickness, wherein the deformable sensor bore wall has a deformable sensor bore wall thickness, and wherein the deformable sensor bore wall thickness is approximately less than or equal to the sidewall thickness.

13. The insert as claimed in claim 6, further comprising an electrical connector for electrically connecting the insert with an electrical power source.

14. The insert as claimed in claim 13 wherein the electrical connector is located adjacent to the second insert end.

15. The insert as claimed in claim 6 wherein the proximal chamber end is located between the first insert end and the first insert mounting component.

16. The insert as claimed in claim 15 wherein the first insert mounting component is comprised of an insert threaded section associated with the housing which is adapted for threaded engagement with the second insert mounting component in order to removably connect the insert with the insert carrier.

17. The insert as claimed in claim 16 wherein the insert threaded section is comprised of a projecting flange associated with the housing and wherein the insert threaded section is further comprised of a thread formed in the projecting flange.

18. The in as claimed in claim 15 wherein the housing sealing mechanism is located between the first insert end and the first insert mounting component.

19. The insert as claimed in claim 18 wherein the first insert mounting component is comprised of an insert threaded section associated with the housing which is adapted for threaded engagement with the second insert mounting component in order to removably connect the insert with the insert carrier.

20. The insert as claimed in claim 19 wherein the insert threaded section is comprised of a projecting flange associated with the housing and wherein the insert threaded section is further comprised of a thread formed in the projecting flange.

21. The insert as claimed in claim 15 wherein the sensor sealing mechanism is located between the first insert end and the first insert mounting component.

22. The insert as claimed in claim 21 wherein the insert is configured so that the insert is connected with the insert carrier by advancing the insert relative to the insert carrier in a direction toward the first insert end and wherein the insert is configured so that the insert is disconnected from the insert carrier by retreating the insert relative to the insert carrier in a direction toward the second insert end.

23. The insert as claimed in claim 22 wherein the first insert mounting component is comprised of an insert threaded section associated with the housing which is adapted for threaded engagement with the second insert mounting component in order to removably connect the insert with the insert carrier.

24. The insert as claimed in claim 23 wherein the insert threaded section is comprised of a projecting flange associated with the housing and wherein the insert threaded section is further comprised of a thread formed in the projecting flange.

25. The insert as claimed in claim 23, further comprising a tool engagement surface located adjacent to the second insert end which is adapted to engage a tool for advancing and retreating the insert relative to the insert carrier.

26. The insert as claimed in claim 25 wherein the tool engagement surface is comprised of a hexagonal surface which is adapted to engage a wrench.

* * * * *